US005904599A

United States Patent [19]

Miller et al.

[11] Patent Number: 5,904,599

[45] Date of Patent: May 18, 1999

[54] ELECTRICAL CONNECTOR PIN DEVICE HAVING WIRE SPRING INSERT

[75] Inventors: Michael W. Miller; Michael J. Schinsky, both of St. Louis, Mo.; Douglas A. Hopper, Maryville, Ill.

[73] Assignee: Hubbell Incorporated, Orange, Conn.

[21] Appl. No.: 08/902,300

[22] Filed: Jul. 29, 1997

[51] Int. Cl.[6] ..... H01R 13/17

[52] U.S. Cl. ..... 439/827; 439/825

[58] Field of Search ..... 439/827, 825, 439/668

[56] References Cited

U.S. PATENT DOCUMENTS

| | | | |
|---|---|---|---|
| 4,422,711 | 12/1983 | Wolowicz | 439/252 R |
| 5,482,468 | 1/1996 | Bolin | 439/668 |

FOREIGN PATENT DOCUMENTS

| | | | |
|---|---|---|---|
| 1363518 | 5/1964 | France | 439/825 |
| 1431842 | 2/1966 | France | 439/825 |
| 3813073 | 7/1989 | Germany | 439/825 |

*Primary Examiner*—Steven L. Stephan
*Assistant Examiner*—Jean F. Duverne
*Attorney, Agent, or Firm*—Jerry M. Presson; Michael R. Swartz

[57] ABSTRACT

An electrical connector pin device includes an elongated body and a wire spring insert. The body has an external surface and defines an axial bore and a radial slot therein. The radial slot extends radially outwardly from the axial bore to the external surface, opening at the external surface. The wire spring insert is disposed within the axial bore and radial slot of the body. The wire spring insert is movable between non-compressed and compressed conditions. In the non-compressed condition, a portion of the wire spring insert extends above the external surface of the body, while in the compressed condition, the wire spring insert is deformed by an annular wall of a sleeve of an external electrical receptacle and pushed below the external surface of the body and thereby generates a spring force creating contact pressure diametrically opposed to the annular wall of the sleeve of the receptacle so as to releasably retain the body within the sleeve of the receptacle.

24 Claims, 2 Drawing Sheets

ELECTRICAL CONNECTOR PIN DEVICE HAVING WIRE SPRING INSERT

BACKGROUND OF THE INVENTION

1. Field of the Invention

The present invention generally relates to devices used in providing electrical connections and, more particularly, is concerned with an electrical connector pin device having a wire spring insert.

2. Description of the Prior Art

The quality of electrical connections are generally crucial to efficient and sustained use of electricity for any number of devices which operate on electrical power. One type of general plug and receptacle electrical connection designed for use in and around industrial plants both indoors and outdoors on portable and stationary equipment utilizes a pin which releasably inserts into a sleeve. The process of achieving an optimum electrical connection involves a balance between the need for secure attachment of the pin within the sleeve and the need for ease of releasability of the pin from the sleeve. A variety of devices have been developed over the years to provide such balance. Many devices utilize separate fastening parts and require specific operations to be carried out for securing the pin and sleeve together and for taking them apart.

Many of the prior art electrical connection devices appear satisfactory in use for the specific purposes for which they were designed. However, none of them seem to provide an optimum solution for obtaining both a secure attachment and ease of releasability of the electrical connection between the pin and sleeve components. Consequently, a need remains for a device that will provide a simple and yet effective solution to the aforementioned problem with the prior art devices without introducing any new problems in place thereof.

SUMMARY OF THE INVENTION

The present invention provides an electrical connector pin device which is designed to satisfy the aforementioned need. The electrical connector pin device of the present invention includes a wire spring insert. The wire spring insert enables the electrical connector pin device to have an optimum connection with a sleeve of an external electrical receptacle without the employment of any separate parts and additional operations. The wire spring insert thus facilitates secure attachment and easy release of a high quality electrical connection.

Accordingly, the present invention is directed to an electrical connector pin device for insertion into a sleeve of an external electrical receptacle which comprises: (a) an elongated body; and (b) a wire spring insert. The body has an external surface and defines an axial bore centrally in the body and a radial slot in the body extending radially outwardly through the body from the axial bore to the external surface, the radial slot opening at the external surface. The wire spring insert is disposed within the axial bore and radial slot of the body and is movable between a substantially non-compressed condition, wherein a portion of the wire spring extends above the external surface of the body, and a substantially compressed condition, wherein the wire spring insert is deformed by an annular wall of a separate sleeve and pushed below the external surface of the body and thereby generates a spring force creating contact pressure diametrically opposed to the annular wall of the sleeve so as to releasably retain the body within the sleeve of the electrical receptacle.

The body has a forward end and a rear end. The external surface of the body diverges at the rear end of the body so as to form a diameter larger than a diameter of the annular wall of the sleeve so as to provide an end stop for the body upon insertion of the body within the sleeve. The axial bore of the body is preferably open at the forward end of the body and is spaced axially inwardly from the rear end of the body.

The body further has a diameter smaller than a diameter of the annular wall of the sleeve so that the body is insertable within the sleeve. The radial slot has a pair of opposite forward and rear top edges spaced a first distance apart from one another at the external surface of the body. The radial slot also has a pair of opposite forward and rear bottom edges disposed substantially tangential to the axial bore and spaced a second distance from one another less than the first distance between the pair of opposite forward and rear top edges of the radial slot of the body.

The wire spring insert has a leading end portion, an arc-shaped trailing end portion and an intermediate portion extending between and interconnecting the leading and trailing end portions. The wire spring insert made of a springy resilient bendable material is retained within the axial bore and radial slot of the body by the leading end portion of the wire spring insert contacting a portion of the body which defines the axial bore, the intermediate portion of the wire spring insert contacting the forward bottom edge of the radial slot of the body, and the trailing end portion of the wire spring insert contacting the rear bottom edge of the radial slot of the body. When assembled, the wire spring insert is in a partially compressed state due to forces created by the wire spring insert abutting the forward bottom edge of the radial slot of the body pushing the wire spring insert rearwardly such that the trailing end portion abuts the rear bottom edge of the radial slot of the body. The leading end portion, intermediate portion and trailing end portion of the wire spring insert are all together formed into a single plane and thereby insertable through the radial slot and disposable in the axial bore of the body.

The wire spring insert further has an out-of-plane bent tip at the trailing end portion which engages the portion of the body defining the axial bore. The trailing end portion also has an over-center point located slightly past a center point of the trailing end portion. The over-center point remains disposed within the axial bore of the body such that more of the trailing end portion is disposed within the axial bore defined by the body than not when the wire spring insert is in the substantially non-compressed and compressed conditions. The presence of the bent tip on the trailing end portion and the location of the over-center point relative to the axial bore prevent the wire spring insert from slipping out of the axial bore and radial slot of the body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
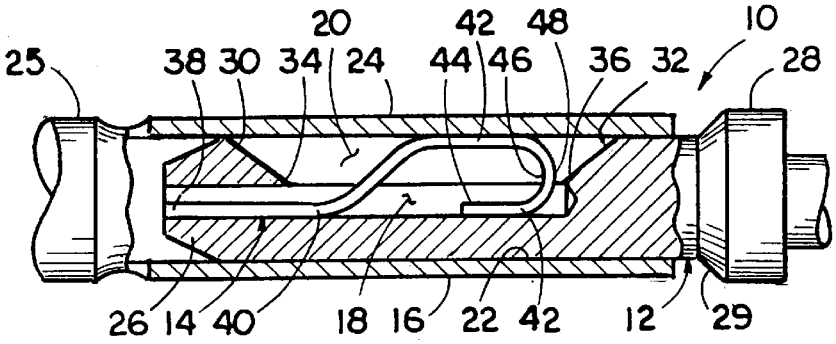
FIG. 1 is a fragmented longitudinal sectional view of an electrical connector pin device of the present invention in an assembled condition within a sleeve of an external electrical receptacle.
Figure 2:
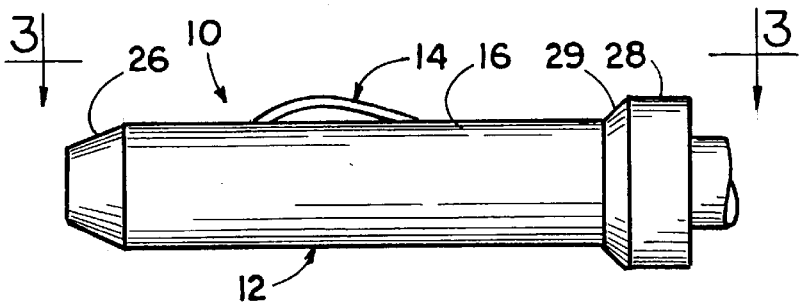
FIG. 2 is a side elevational view of the electrical connector pin device in the assembled condition removed from the sleeve of the external electrical receptacle.

Referring to the drawings and particularly to FIGS. 1 to 4, there is illustrated an electrical connector pin device, generally designated 10, of the present invention. Basically, the electrical connector pin device 10 includes an elongated body 12 and a wire spring insert 14. The body 12 has an annular-shaped external surface 16 and defines an axial bore 18 extending centrally in the body 12 and a radial slot 20 extending radially outwardly through the body 12 from the axial bore 18 and to the external surface 16 of the body 12, opening at its external surface 16. The wire spring insert 14 is disposed within the axial bore 18 and radial slot 20 of the body 12 and is movable between a substantially non-compressed condition, as shown particularly in FIGS. 2, 3 and 4, and a substantially compressed condition, as shown particularly in FIG. 1. In the non-compressed condition of the wire spring insert 14, a portion of the wire spring insert 14 extends above the external surface 16 of the body 12. In the compressed condition, the wire spring insert 14 is deformed by an annular wall 22 of a sleeve 24 of an external electrical receptacle 25 and pushed below the external surface 16 of the body 12 and thereby generates a spring force creating contact pressure diametrically opposed to the wall 22 of the sleeve 24 of the receptacle 25 so as to releasably retain the body 12 within the sleeve 24.

Referring now to FIGS. 1 to 6, more particularly the body 12 is substantially cylindrical in shape, but may have any other suitable configuration. The body 12 has a forward end 26 and a rear end 28. The external surface 16 of the body 12 converges at the forward end 26 of the body 12. The external surface 16 diverges at the rear end 28 of the body 12 so as to form a diameter larger than a diameter of the annular wall 22 of the sleeve 24 of the receptacle so as to provide an annular end stop 29 for the body 12 upon insertion of the body 12 within the sleeve 24. The axial bore 18 of the body 12 is preferably open at the forward end 26 of the body 12 and is spaced inwardly from the rear end 28 of the body 12. The axial bore 18 may alternatively be closed at both of its ends and spaced inwardly from both the forward and rear ends 26, 28 of the body 12. The body 12 of the pin 10 and the sleeve 24 of the receptacle 25 are comprised of a substantially rigid metal material, such as brass.

The body 12 further has a diameter smaller than a diameter of the annular wall 22 of the sleeve 24 of the receptacle so that the body 12 is insertable within the sleeve 24. In an exemplary embodiment, the axial bore 18 has a diameter of 0.0625 inches (0.15875 cm) and length of 0.56 inches (1.4224 cm), but can have any other suitable size. Also, the radial slot 20 has a width extending a distance half that of the diameter of the axial bore 18. The radial slot 20 has a pair of opposite forward and rear top edges 30, 32 spaced a first distance apart from one another at the external surface 16 of the body 12. The radial slot 20 also has a pair of opposite forward and rear bottom edges 34, 36 tangential to the axial bore 18 and spaced a second distance from one another less than the first distance between the pair of opposite forward and rear top edges 30, 32 of the radial slot 20 of the body 12.

Referring now to FIGS. 1 to 4 and 7 to 11, the wire spring insert 14 has a leading end portion 38, a hook- or arc-shaped trailing end portion 42 and an intermediate portion 40 extending between and interconnecting the leading and trailing end portions 38, 42. The wire spring insert 14 is retained within the axial bore 18 and radial slot 20 of the body 12 by the leading end portion 38 of the wire spring insert 14 contacting a portion of the body 12 defining the axial bore 18, the intermediate portion 40 of the wire spring insert 14 contacting the forward bottom edge 34 of the radial slot 20 of the body 12, and the trailing end portion 42 of the wire spring insert 14 contacting the rear bottom edge 36 of the radial slot 20 of the body 12. When assembled, the wire spring insert 14 is in a partially compressed (deformed) condition due to forces created by the wire spring insert 14 abutting the forward bottom edge 34 of the radial slot 20 of the body 12 pushing the wire spring insert 14 rearwardly such that the trailing end portion 42 abuts the rear bottom edge 36 of the radial slot 20 of the body 12. The wire spring insert 14 is comprised of a springy, resilient, deformable rigid material, such as beryllium copper but may be made of any other suitable metal material, and in an exemplary embodiment has a diameter of 0.025 inches (0.0625 cm), but can have any other suitable size. The leading end portion 38, intermediate portion 40 and trailing end portion 42 of the wire spring insert 14 are all together formed into a single plane and thereby insertable through the radial slot 20 and disposable in the axial bore 18 of the body 12.

Figure 3:
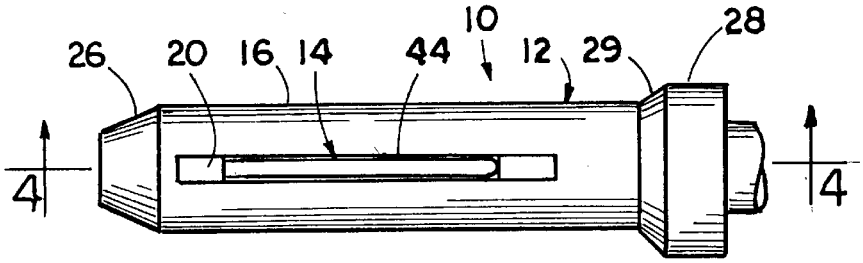
FIG. 3 is a top plan view of the device as seen along lines 3—3 of FIG. 2.
Figure 4:
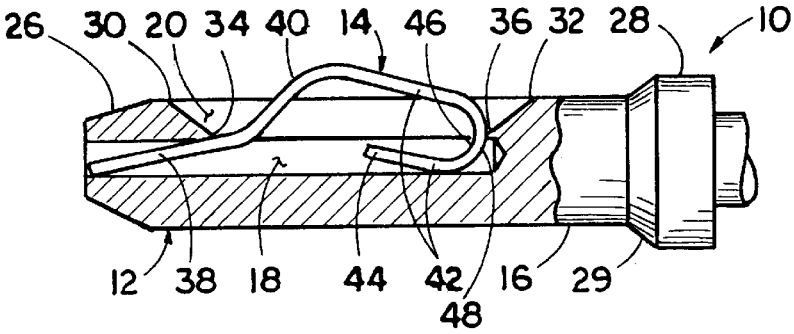
FIG. 4 is a longitudinal partially sectional view of the device taken along lines 4—4 of FIG. 3.
Figure 8:
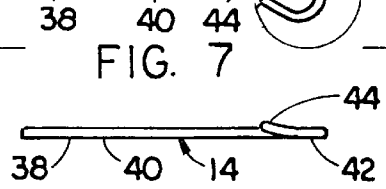
FIG. 8 is a top plan view of the wire spring insert as seen along lines 8—8 of FIG. 7.

Also, as seen in FIGS. 3 and 8, the wire spring insert 14 further has an out-of-plane bent tip 44 at the trailing end portion 42 which engages a portion of the body 12 defining the axial bore 18. As best seen in FIG. 4, the trailing end portion 42 also has an over-center point 46 located slightly past a center point 48 of the trailing end portion 42. The over-center point 46 remains disposed within the axial bore 18 of the body 12 such that more of the trailing end portion 42 is disposed within the axial bore 18 of the body 12 than not when the wire spring insert 14 is in the substantially non-compressed and compressed (deformed) conditions. The presence of the bent tip 44 on the trailing end portion 42 and the location of the over-center point 46 relative to the axial bore 18 prevent the wire spring insert 14 from slipping out of the axial bore 18 and radial slot 20 of the body 12.

Figure 9:
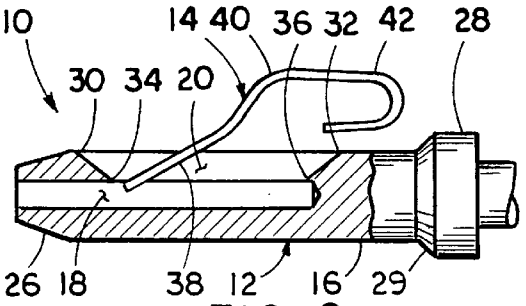
FIGS. 9 to 11 show the steps in assembling the wire spring insert into the body of the device.
Figure 10:
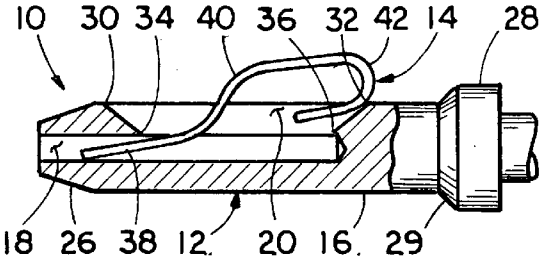
Figure 11:
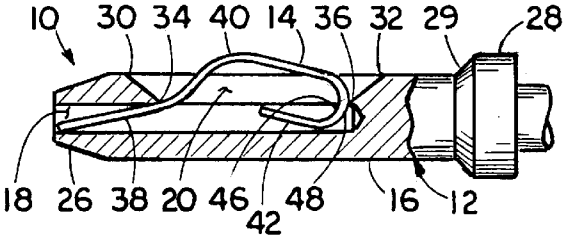
Figure 5:
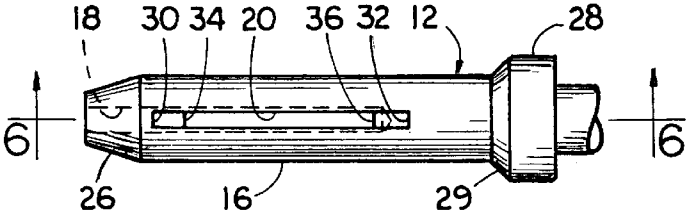
FIG. 5 is a top plan view of an elongated body of the device disassembled from a wire spring insert of the device.
Figure 6:
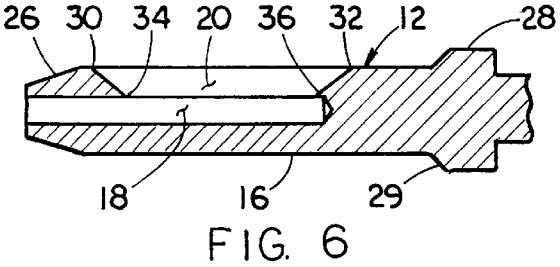
FIG. 6 is a longitudinal sectional view of the body taken along lines 6—6 of FIG. 5.
Figure 7:
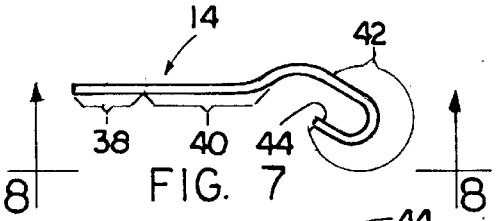
FIG. 7 is a side elevational view of the wire spring insert of the device disassembled from the body of the device.

Referring to FIGS. 9 to 11, there is illustrated the steps in assembling the electrical connector pin device 10. FIG. 9 shows the leading end portion 38 of the wire spring insert 14 being placed within the radial slot 20 of the body 12 and entering the axial bore 18 of the body 12. Next, FIG. 10 shows the leading end 38 of the wire spring insert 14 inserted farther into the axial bore 18 of the body 12 and the trailing end portion 42 of the wire spring insert 14 entering the radial slot 20 of the body 12. Finally, FIG. 11 shows the wire spring insert 14 fitted into the substantially non-compressed assembled condition disposed within the axial bore 18 and radial slot 20 of the body 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An electrical connector pin device, comprising:

(a) an elongated body having an external surface and defining an axial bore centrally in said body and a radial slot in said body extending radially outwardly through said body from said axial bore to said external surface, said radial slot opening at said external surface; and (b) a wire spring insert disposed within said axial bore and radial slot of said body and being movable between a substantially non-compressed condition wherein a portion of said wire spring insert extends above said external surface of said body and a substantially compressed condition wherein said wire spring insert is deformed by an annular wall of a sleeve of an external electrical receptacle and pushed below said external surface of said body and thereby generates a spring force creating contact pressure diametrically opposed to the annular wall of the sleeve of the receptacle so as to releasably retain said body within the sleeve of the receptacle;

said wire spring insert having a leading end portion, an arc-shaped trailing end portion and an intermediate portion extending between and interconnecting said leading and trailing end portions, all of said leading and trailing end portions and intermediate portion substantially formed in a single plane and thereby being insertable through said slot and disposable in said axial bore of said body, said trailing end portion having an out-of-plane bent tip engaging a portion of said body when said wire spring insert is disposed in said non-compressed condition.

2. The device as recited in claim 1, wherein said body is substantially cylindrical in shape.

3. The device as recited in claim 1, wherein said body further has a forward end and said external surface of said body converges at said forward end of said body.

4. The device as recited in claim 1, wherein said body further has a rear end and said external surface of said body diverges at said rear end of said body so as to form a diameter larger than a diameter of the wall of the sleeve of the external electrical receptacle so as to provide an end stop for said body upon insertion of said body within the sleeve of the external electrical receptacle.

5. The device as recited in claim 1, wherein said body further has a forward end and said axial bore defined by said body is open at said forward end of said body.

6. The device as recited in claim 1, wherein said body further has a rear end and said axial bore defined by said body is spaced inwardly from said rear end of said body.

7. The device as recited in claim 1, wherein said body further has a diameter smaller than a diameter of the wall of the sleeve of the external electrical receptacle so that said body is insertable within the sleeve of the external electrical receptacle.

8. The device as recited in claim 1, wherein said axial bore defined by said body has a diameter and said radial slot defined by said body has a width extending a distance about half that of the diameter of said axial bore defined by said body.

9. The device as recited in claim 1, wherein said wire spring insert is comprised of a springy resiliently deformable rigid material.

10. The device as recited in claim 1, wherein said trailing end of said wire spring insert has an over-center point which remains disposed within said axial bore of said body such that more of said trailing end portion is disposed within said axial bore defined by said body than not when said wire spring insert is in said substantially non-compressed and compressed conditions.

11. The device as recited in claim 1, wherein said slot defined by said body has a pair of opposite forward and rear top edges spaced a first distance apart from one another at said external surface of said body and a pair of opposite forward and rear bottom edges tangential to said axial bore defined by said body and being spaced a second distance from one another less than the first distance between said pair of opposite forward and rear top edges of said radial slot defined by said body.

12. The device as recited in claim 11, wherein said wire spring insert has a leading end portion, an arc-shaped trailing end portion and an intermediate portion extending between and interconnecting said leading and trailing end portions, said wire spring insert being retained within said axial bore and radial slot of said body by simultaneous contact of said leading end portion of said wire spring insert with a portion of said body defining said axial bore, said intermediate portion of said wire spring insert with said forward bottom edge of said slot of said body, and said trailing end portion with said rear bottom edge of said slot of said body.

13. An electrical connector pin device, comprising:

(a) a body having an external surface and defining an axial bore and a radial slot extending radially outwardly from said axial bore to said external surface and opening at said external surface, said radial slot having a pair of opposite forward and rear top edges spaced a first distance apart from one another at said external surface of said body and a pair of opposite forward and rear bottom edges tangential to said axial bore defined by said body and being spaced a second distance from one another less than said first distance between said pair of opposite forward and rear top edges of said radial slot of said body; and (b) a wire spring insert having a leading end portion, an arc-shaped trailing end portion and an intermediate portion extending between and interconnecting said leading and trailing end portions, said wire spring insert being retained within said axial bore and radial slot of said body by simultaneous contact of said leading end portion of said wire spring insert with a portion of said body defining said axial bore, said intermediate portion of said wire spring insert with said forward bottom edge of said radial slot of said body and said trailing end portion of said wire spring insert with said rear bottom edge of said radial slot of said body, said wire spring insert being deformably movable between a substantially non-compressed condition wherein a portion of said wire spring insert extends above said external surface of said body and a substantially compressed condition wherein said wire spring insert is deformed by a wall of a sleeve of an external electrical receptacle and pushed below said external surface of said body and thereby generates a spring force creating contact pressure diametrically opposed to the wall of the sleeve of the external electrical receptacle so as to releasably retain said body within the sleeve of the external electrical receptacle.

14. The device as recited in claim 13, wherein said body is substantially cylindrical in shape.

15. The device as recited in claim 13, wherein said body further has a forward end and said external surface of said body converges at said forward end of said body.

16. The device as recited in claim 13, wherein said body further has a rear end and said external surface of said body diverges at said rear end of said body so as to form a diameter larger than a diameter of the wall of the sleeve of the external electrical receptacle so as to provide an end stop for said body upon insertion of said body within the sleeve of the external electrical receptacle.

17. The device as recited in claim 13, wherein said body further has a forward end and said axial bore of said body is open at said forward end of said body.

18. The device as recited in claim 13, wherein said body further has a rear end and said axial bore of said body is spaced inwardly from said rear end of said body.

19. The device as recited in claim 13, wherein said body further has a diameter smaller than a diameter of the wall of the sleeve of the external electrical receptacle so that said body is insertable within the sleeve of the external electrical receptacle.

20. The device as recited in claim 13, wherein said axial bore of said body has a diameter and said radial slot of said body has a width extending a distance about half that of the diameter of said axial bore of said body.

21. The device as recited in claim 13, wherein said wire spring insert is comprised of a springy resiliently deformable rigid material.

22. The device as recited in claim 13, wherein said wire spring insert is substantially formed in a single plane and is thereby insertable through said radial slot and disposable in said axial bore of said body.

23. The device as recited in claim 13, wherein said wire spring insert has an out-of-plane bent tip at said trailing end portion engaging a portion of said body defining said axial bore.

24. The device as recited in claim 13, wherein said trailing end of said wire spring insert has an over-center point which remains disposed within said axial bore of said body such that more of said trailing end portion is disposed within said axial bore of said body than not when said wire spring is in said substantially non-compressed and compressed conditions.

* * * * *